US005926943A

United States Patent [19]

Kashy

[11] Patent Number: 5,926,943

[45] Date of Patent: Jul. 27, 1999

[54] BRAID SHIELDED RF BELLOWS

[75] Inventor: David H. Kashy, Yorktown, Va.

[73] Assignee: Southeastern Univ. Research Assn., Newport News, Va.

[21] Appl. No.: 08/799,354

[22] Filed: Feb. 14, 1997

[51] Int. Cl.[6] ..... H01P 11/00

[52] U.S. Cl. ..... 29/600; 29/454; 53/449; 333/257

[58] Field of Search ..... 29/600, 458; 53/449; 333/244, 254, 257

[56] References Cited

U.S. PATENT DOCUMENTS 2,436,421 2/1948 Cork ..... 138/125

4,845,448 7/1989 Olsson ..... 333/254

5,528,208 6/1996 Kabayashi ..... 333/241

*Primary Examiner*—John Sipos

*Assistant Examiner*—Bobby Rushing, Jr.

[57] ABSTRACT

A connecting joint for a radio frequency waveguide line comprises a tubular metallic braid wire shield connecting two beam line pipe ends thereby making the inside surface appear as a continuous beam tube. The metallic braid wire is secured within a bellows assembly that allows the connecting joint to expand or contract as is appropriate for changes in ambient conditions or conditions within the waveguide line. The connecting joint is capable of supporting either positive or negative pressure within the joint while the exterior of the joint may vary with ambient conditions.

2 Claims, 1 Drawing Sheet

BRAID SHIELDED RF BELLOWS

FIELD OF THE INVENTION

This invention relates to shielding radio frequency (RF) waves within a waveguide, and in particular, to a braid shielded RF bellows assembly. A metallic tubular braided-wire shield connects two beam line pipe ends thereby making the inside surface appear as a continuous beam tube. A bellows surrounds this braided-wire shielding. The tube may be fastened by welding, brazing, or other suitable method.

BACKGROUND OF THE INVENTION

Waveguides that transmit RF energy commonly require flexible joints to connect fixed portions of the waveguide. These flexible joints must be capable of expanding or contracting with temperature changes to compensate for the expansion or contraction of the fixed portions of the waveguides that they join together. The flexible joints must be capable of not attenuating or degrading the RF signals that are transmitted within them. In addition, the flexible joints must be capable of maintaining the positive or extreme negative pressure that is commonly held within the waveguide.

In the prior art, flexible joints for waveguides have been proposed which include a bellows assembly within a telescoping outer shield. Having the bellows in the inner part of the wave guide, immediately surrounding the RF energy, can lead to degradation of the signals within the bellows as a result of the irregular shape of the bellows. This design, having a telescoping outer shield and an inner bellows assembly is of complex construction.

As described by these several limitations, flexible waveguide joints of the present art have not proven fully satisfactory for transmitting RF energy simply and without signal degradation.

SUMMARY OF THE INVENTION

This invention provides an improved flexible joint for wave guides which includes a bellows assembly on the outer periphery of the flexible joint to allow for expansion and contraction as caused by temperature changes. The invention furthermore provides a tubular wire braid having a smooth and even inner diameter that acts as the wave guide within the flexible joint to hold the RF energy with minimum degradation. The tubular wire braid is free to expand and contract with the bellows and yet allow a non-degraded RF signal to pass therethrough.

The improved flexible joint of this invention provides a joint that is of simple construction, easy to fabricate, maintains a proper hermetic seal between the inner waveguide pressure and the pressure outside the joint, and holds RF signal degradation to a minimum.

OBJECTS AND ADVANTAGES

A principal object of the present invention is to provide a flexible wave guide joint that will not degrade the signal within the wave guide.

A second object of the present invention is to provide a flexible wave guide joint that is simple and easy to construct.

A third object of the present invention is to provide a flexible wave guide joint that will hold a hermetic seal between the positive or negative pressure within the wave guide and the ambient pressure outside of the wave guide.

Other objects and advantages of the preferred embodiment will become apparent when reading the attached description of the invention and referring to the associated drawings.

DESCRIPTION OF THE INVENTION

Figure 1:
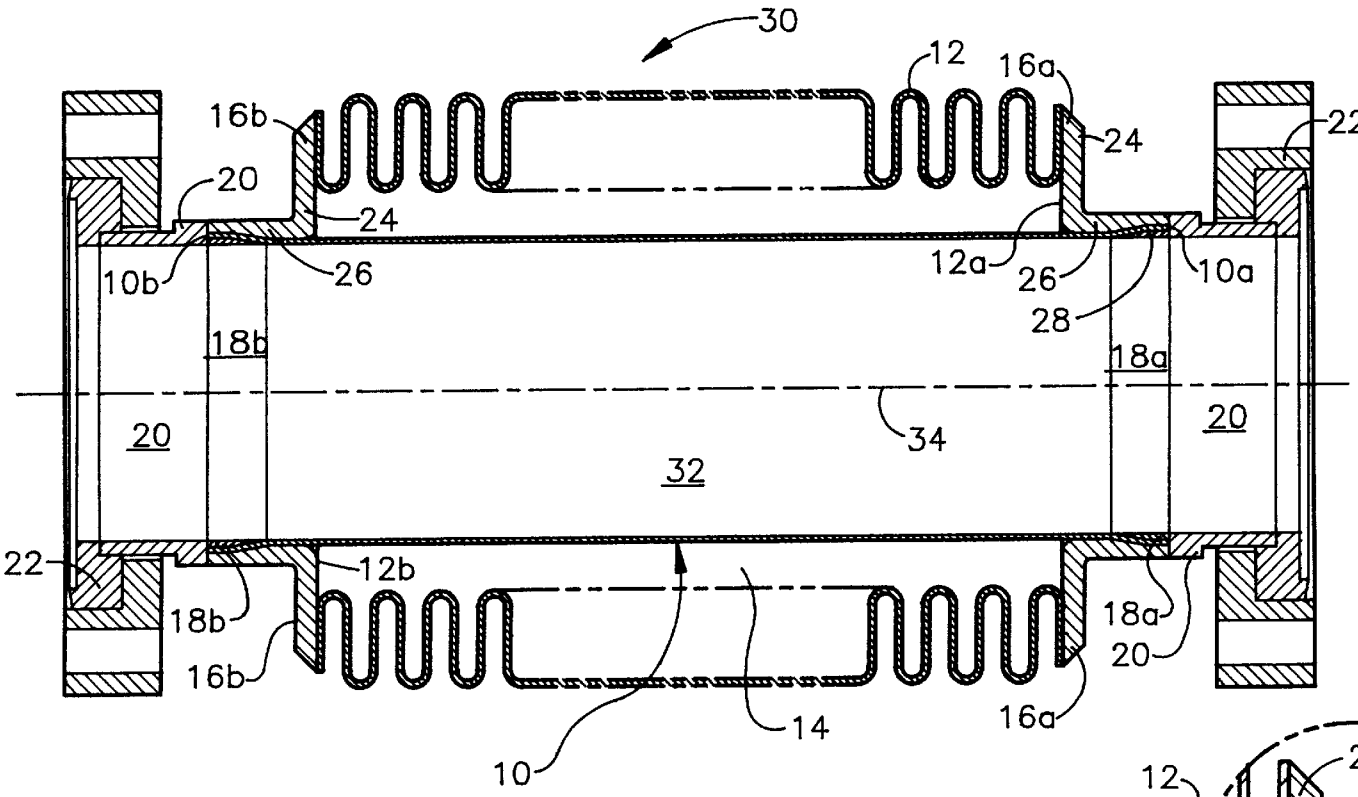
FIG. 1 is a cross-sectional view of the preferred embodiment of the braid shielded RF bellows.

The invention is a braid shielded RF bellows for providing a flexible connecting joint for joining two RF wave guide sections. A cross-sectional view is provided of the braid shielded RF bellows 30 in FIG. 1. The braid shielded RF bellows 30 includes the bellows sub assembly 14 consisting of a bellows 12, a first cuff 16*a* and a second cuff 16*b*, a piece of tubular braid wire 10, a first jam ring 18*a* and a second jam ring 18*b*, two conflat adapter rings 20, and two conflat flanges 22. The first cuff 16*a* and second cuff 16*b* each have a flange portion 24 and a tubular portion 26 as shown in FIG. 1. All these separate pieces comprise the braid shielded RF bellows 30 as shown in FIG. 1 and provide a longitudinal passageway or channel 32 along central axis 34 through which RF waves may be transmitted with little degradation in strength. The bellows sub assembly 14 also provides a hermetic seal through which either positive or negative pressure within the channel 32 is isolated from ambient pressure outside of the bellows sub assembly 14.

Figure 2:
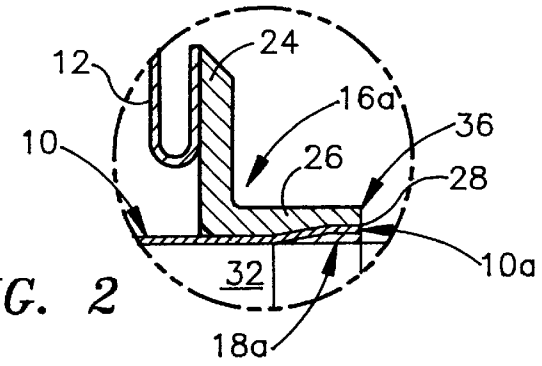
FIG. 2 is a detail view of the section of FIG. 1 showing one end of the tubular wire braid pressed by the jam ring into the cuff.

FIG. 2 is a detail view of a section of FIG. 1 showing a first end 10*a* of the tubular braid wire 10 pressed by the first jam ring 18*a* into the first cuff 16*a*. As shown in FIG. 2, the first cuff 16*a* includes a flange portion 24 that is secured to the bellows sub assembly 14 and a tubular portion 26 through which the tubular braid wire 10 is threaded. A recess 28 is formed on the inner periphery of the tubular portion 26 of the first cuff 16*a* enabling the first jam ring 18*a* to be pressed into the channel 32 until the first jam ring 18*a* is flush with the end 36 of the tubular portion 26 of the first cuff 16*a*. The excess wire braid that extends beyond the end 36 of the tubular portion 26 of the first cuff 16*a* may then be trimmed off with a clean sharp tin snips. The opposite end of the braid shielded RF bellows 30 has parts on its opposite end analogous to those on the first end, including a second cuff 16*b* having a flange portion 24 and a tubular portion 26 also with a recess in the inner periphery of the tubular portion 26. The second jam ring 18*b* is pressed into the second cuff 16*b* in an analogous manner as was done with the first end of the braid shielded RF bellows 30, thereby pressing and holding the second end of the tubular braid wire 10*b* between the second jam ring 18*b* and the second cuff 16*b*.

The braid shielded RF bellows 30 is constructed, referring to FIG. 1, by first providing a piece of braid wire. A typical specification of the braid wire as used in this invention may be obtained from New England Wire Corporation, Lisbon, N.H. The wire braid used was New England Wire Corporation's type 304 stainless steel wire braid part number NES480130SS.

The braid wire is cut to the desired length, typically 18 inches. The cut piece of braid wire is then verified as being free of any bends or any crossed wires. The cut piece of braid wire is then squeezed into a circular cross section from the oval as provided, typically 1.375 inches in diameter. The resulting tubular braid wire 10 is then cleaned ultrasonically for at least 10 minutes in a minimum of 2 positions and at two different states of length.

The bellows sub assembly 14 in FIG. 1 is constructed by first cutting a bellows 12 to the desired length, typically 4.13 inches. A metallic cuff is then formed to fit each end of the bellows 12, in FIG. 1 a first cuff 16*a* and a second cuff 16*b* are shown. The bellows sub assembly 14 is then formed by securing the bellows 12 to the cuffs 16*a,* 16*b* by welding, brazing, or some other appropriate means. The bellows sub assembly 14 is then cleaned appropriately for use in ultra high vacuum. The bellows sub assembly 14 is then installed in a clean fixture to hold it to an appropriate length, typically 4.13 inches, and to keep the cuffs 16*a,* 16*b* parallel.

With the bellows sub assembly 14 held in the clean fixture, the tubular braid wire 10 is slid through its interior channel 32. A first jam ring 18*a* is then pressed into the inner periphery of the first end 10*a* of the tubular braid wire thereby jamming the tubular braid wire 10 between the first jam ring 18*a* and the first cuff 16*a*. A recess 28 is formed on the inner periphery of the tubular portion 26 of the first cuff 16*a* allowing a space for the first end 10*a* of the tubular braid wire to be held within. The first jam ring 18*a* is then welded in several places to the first cuff 16*a* in several places to hold it fast. Any excess braid wire extending beyond the end 36 of the tubular portion 26 of the first cuff 16*a* is then cut off the end of the bellows sub assembly 14 using clean sharp tin snips. A fusion weld is then completed around the perimeter of the first cuff 16*a*.

With the tubular braid wire 10 jammed flush, welded, and thereby secured at its first end 10*a,* the inside diameter of the tubular braid wire 10 within the bellows sub assembly 14 is manually smoothed to the desired diameter of approximately 1.375 inches. The second jam ring 18*b* is then pressed into the inner periphery of the second end 10*b* of the tubular braid wire 10 thereby forcing the second end 10*b* into the recess 28 in the inner periphery of the tubular portion 26 of the second cuff 16*b*. The second end 10*b* of the tubular braid wire 10 is then held fast between the second jam ring 18*b* and the second cuff 16*b,* with the end 36 of the tubular portion 26 of the second cuff 16*b* flush with the second jam ring 18*b*. The tubular braid wire 10 is then verified that it remains at the desired inside diameter of 1.375 inches. The second jam ring 18*b* is then welded to the second cuff 16*b* in several places and the excess braid wire is cut off of the second end of the bellows sub assembly 14 using clean sharp tin snips. A fusion weld is then made around the perimeter of the second cuff 16*b*.

The tubular braid wire 10 is now smoothed to the correct inside diameter and secured to each end of the bellows sub assembly 14. With this assembly still held within a clean fixture, conflat adapter rings 20 are aligned with the cuffs 16*a,* 16*b* at each end of the bellows sub assembly 14. The conflat adapter rings 20 are then welded with a full penetration weld to each of said cuffs, 16*a* and 16*b*.

The bellows sub assembly 14 with the secured tubular braid wire 10, jam rings 18*a* and 18*b,* and conflat adapter rings 20 is then baked in a vacuum furnace at 600° C. for one hour and allowed to cool under vacuum. Conflat flanges 22, as shown in FIG. 1, are then aligned with each of the conflat adapter rings 20 on their respective ends of the bellows sub assembly. The conflat flanges 22 are then welded to the conflat adapter rings 20 to complete the braid shielded RF bellows 30. The completed braid shielded RF bellows 30 is then double bagged with first a nylon bag and then a polyethylene bag until needed for joining two sections of the RF wave guide.

As can be seen in FIG. 2, the inside diameter of the assembly is constant at typically 1.375 inches. To keep this constant diameter the jam ring outside diameter and shape and the inside diameter and shape of recess 28 complement each other including the thickness of the braid 10 therebetween. Typically the inside dimensions of the recess 28 are 1.422 inches diameter at the inner end with the recess starting at the outer end with a diameter of 1.485 inches. This diameter is constant for 0.100 inches from the outer end then starts to taper inward for a distance of 0.179 inches until the 1.422 inches diameter is reached. The entire depth of the cuff is typically 0.500 inches. The jam ring 18*a* has a depth that is typically 0.270 inches, a uniform inside diameter of 1.375 inches and an outside diameter that complements the recess 28 including taking in consideration the thickness of the braid. The outside diameter on the inner end is 1.375 inches tapering for 0.170 inches to an outside diameter of 1.435 inches which continues as the uniform outside diameter for an additional 0.100 inches at the outer end.

What is claimed is:

1. A method of constructing a braid shielded RF bellows comprising:

providing a piece of braid wire;

cutting said piece of braid wire to a desired length;

verifying that said piece of braid wire has no bent or crossed wires;

squeezing said piece of braid wire manually to force said piece into a circular cross section from the oval as provided;

cleaning said tubular piece of braid wire ultrasonically for at least 10 minutes;

cutting a bellows to the desired length;

forming a cuff to fit each end of said bellows;

forming a bellows sub assembly by securing said bellows to said cuffs;

cleaning said bellows sub assembly appropriately for use in ultra high vacuum;

installing said bellows sub assembly in a clean fixture to hold it to an appropriate length and to keep said cuffs parallel;

sliding said tubular braid wire through said bellows;

pressing a first jam ring into the inner periphery of a first end of said tubular braid wire thereby forcing said first end of said tubular braid wire into a first cuff at the first end of said bellows sub assembly;

welding said first jam ring to said first cuff in several places;

cutting the excess braid wire off said first end of said bellows sub assembly using clean sharp tin snips;

welding around the perimeter of said first cuff;

smoothing the inside diameter of said tubular braid wire within said bellows sub assembly to the desired diameter;

pressing a second jam ring into the inner periphery of the second end of said tubular braid wire thereby forcing said second end of said tubular braid wire into a second cuff at the second end of said bellows sub assembly;

verifying the inside diameter of said tubular braid wire remains the desired diameter;

welding said second jam ring to said second cuff in several places;

cutting the excess braid wire off said second end of said bellows sub assembly using clean sharp tin snips;

welding around the perimeter of said second cuff;

aligning conflat adapter rings with said cuffs at each end of said bellows sub assembly;

welding said conflat adapter rings with a full penetration weld to each of said cuffs;

baking said bellows sub assembly secured to said tubular braid wire, said jam rings, and said conflat adapter rings in a vacuum furnace at 600° C. for one hour and let cool under vacuum;

aligning conflat flanges with each of said conflat adapter rings secured to each end of said bellows sub assembly;

welding said conflat flanges to said conflat adapter rings; and double bagging completed assembly including said bellows sub assembly, said tubular braid wire, said jam rings, said conflat adapter rings and said conflat flanges with first a nylon bag and then a polyethylene bag.

2. The braid shielded RF bellows of claim 1 wherein:

said desired cut length of braid wire is approximately 18 inches;

said appropriate length of said bellows sub assembly in said clean fixture is approximately 4.13 inches;

said desired diameter of said tubular braid wire within said bellows sub assembly is smoothed to approximately 1.375 inches; and said verified diameter of said tubular braid wire is approximately 1.375 inches.

* * * * *